United States Patent [19]

Cinel et al.

[11] Patent Number: 4,844,132

[45] Date of Patent: Jul. 4, 1989

[54] GRIPPER TAPE DRIVE DEVICE FOR SHUTTLELESS LOOM

[75] Inventors: Luciano Cinel, San Vito di Leguzzano; Giorgio Cortiana, Piovene Rocchette; Filippo Freschie, Vicenza; Gianni Ceccherini, Sesto Fiorentino; Vittorio Cocchi, Florence, all of Italy

[73] Assignees: Enricherche, S.p.A., Milan; Enichem Augusta, S.p.A., Palermo, both of Italy

[21] Appl. No.: 225,863

[22] Filed: Jul. 20, 1988

[30] Foreign Application Priority Data

Aug. 24, 1987 [IT] Italy ..... 21699 A/87

[51] Int. Cl.[4] ..... D03D 47/27

[52] U.S. Cl. ..... 139/449

[58] Field of Search ..... 139/449, 441, 444, 445, 139/446; 74/25, 29

[56] References Cited

FOREIGN PATENT DOCUMENTS

| | | | |
|---|---|---|---|
| 3029642 | 2/1981 | Fed. Rep. of Germany | 139/449 |
| 3501550 | 8/1985 | Fed. Rep. of Germany | 139/449 |
| 0125940 | 7/1984 | Japan | 139/449 |

*Primary Examiner*—Henry S. Jaudon

*Attorney, Agent, or Firm*—Morgan & Finnegan

[57] ABSTRACT

A gripper tape drive device for a shuttleless loom, in which a circular disc is mounted coaxial but not perpendicular to the main loom shaft, its outer circular edge rotatably engaging a circular collar, of which two opposing pins spaced 180° apart cooperate with the ends of a fork rigid with the control shaft of the gripper tape sprocket. Adjustment means are also provided for varying the amplitude of the oscillatory motion of said control shaft.

3 Claims, 2 Drawing Sheets

GRIPPER TAPE DRIVE DEVICE FOR SHUTTLELESS LOOM

This invention relates to a gripper tape drive device for a shuttleless loom which combines a simple, compact structure of low cost and very small dimensions by virtue of the absence of costly parts such as complementary cams and bevel gears, with simple and rapid adjustment of the tape travel.

In shuttleless looms the weft yarns are inserted into the shed by two grippers which, starting from opposite sides of the loom, are driven with rectilinear motion to the centre of the shed where they exchange the weft yarn and are then moved out of the shed into their initial position. Each gripper is driven with this reciprocating movement generally by a flexible gripper tape perforated along its length, the perforations being engaged by a drive sprocket, the control shaft of which derives its rocking movement from the main loom shaft.

Thus, a drive device for the gripper tapes is required, ie a device able to convert the uniform rotary motion of the main loom shaft, which extends along the length of the loom, into oscillatory movement of the gripper tape control shaft disposed orthogonally to said main shaft, and consequently into reciprocating rectilinear motion of the gripper tapes and thus of the grippers themselves.

On the other hand, said drive device must have the facility for adjusting the amplitude of the oscillatory motion of the control shaft and thus for varying the gripper stroke in accordance with the desired weaving height.

The known art already comprises various devices for converting continuous rotary motion of one shaft into oscillatory motion of another shaft where the shafts are disposed orthogonally to each other, however only those devices which use so-called spatial linkages have been found to give the output shaft, and thus the gripper, a motion with good dynamic characteristics.

In one of these known methods, the operating device consists of a spatial connecting rod linkage in which the uniform rotary motion of the main shaft is converted into oscillatory motion of the gripper tape control shaft by a crank fixed so that it projects from the end of the main shaft and connected with adjustable eccentricity to an entrained member which is thus driven with oscillatory motion about its pivotal axis, disposed orthogonal to the main shaft. The amplitude of the oscillatory movement and thus the gripper stroke are adjusted by varying the eccentricity of the point of connection between the crank and the entrained member.

This known device has however the drawback of a certain constructional complexity and a considerable overall size due to the rotary connection between the crank and entrained member. Similar drawbacks with even more extensive overall size problems are encountered in another known spatial linkage which uses a crank of fixed eccentricity, the amplitude of the oscillatory motion of the gripper tape control shaft being adjusted by a bulky articulated adjustment quadrilateral having one arm of adjustable eccentricity.

The object of the present invention is to obviate the aforesaid drawbacks by providing a gripper tape drive device for a shuttleless loom which is compact, is constructionally simple and allows easy adjustment of the gripper stroke.

This is substantially attained by a spatial linkage not of the connecting rod type but of the "spatial disc" type in which a circular disc is disposed with its plane not perpendicular to the axis of the main loom shaft, to which it is centrally fixed in an angularly adjustable manner, said disc being rotatably connected by its outer circular edge to a circular collar provided with two outer opposing pins 180° apart which cooperate with the ends of a fork rigid with the step-up gear which acts on the drive sprocket of a gripper tape.

More specifically, the gripper tape drive device for a shuttleless loom for converting the uniform rotary motion of the main loom shaft into oscillatory motion of a control shaft which is disposed orthogonal to said main shaft and operates the drive sprocket of a longitudinally-perforated gripper-carrying flexible tape by way of a step-up gear consisting of a toothed sector fixed onto said control shaft and engaging with a pinion rigid with said sprocket, is characterised according to the present invention by comprising a circular disc mounted coaxially at one end of said main loom shaft in a manner not perpendicular to the axis of said main shaft, the outer circular edge of said disc engaging rotatably and with biaxial and radial restraints in a circular collar provided externally with two opposing pins spaced 180° apart and cooperating with the ends of a fork rigid with one end of said control shaft, the axis of which passes through the centre of symmetry of said circular disc, adjustment means being provided for varying the amplitude of the oscillatory motion of said control shaft.

According to a preferred embodiment of the present invention said adjustment means for varying the amplitude of the control shaft oscillatory motion consists substantially of a hemispherical joint integral with the circular disc and having its centre at said centre of symmetry of the disc, and engage in a corresponding hemispherical cavity provided in said end of the main shaft, in which it is locked in the desired angular position by screws passing through elongated adjustment slots provided parallel to each other is said joint, which in its outer surface comprises a guide groove for a pin projecting from said cavity, said groove sand said slots being disposed in planes parallel to the plane defined by the axis of the main shaft and the perpendicular to the circular disc.

Finally, according to a further characteristic of the invention, and as confirmed both analytically and experimentally, in order to enable the speed of the oscillatory motion of said control shaft and thus the speed of the gripper to be reduced during the gripping of the weft yarn and thus increase the reliability of this grip during the transfer of the yarn into the shed, said two 180°-apart opposing pins of said circular collar are disposed on a common axis which passes through said centre of symmetry of the circular disc and forms a certain angle with the the plane of the disc passing through said centre of symmetry.

The invention is described hereinafter with reference to the accompanying drawings which illustrate a preferred embodiment by way of non-limiting example only in that technical and constructional modifications can be made thereto but without leaving the scope of the present invention.

Thus, instead of using a hemispherical joint, a semi-cylindrical joint and a corresponding semi-cylindrical cavity can be used, thus obviating the need for said pin and said guide groove for preventing rotation of the joint about the axis of the main shaft. Again, the adjustment means for varying the amplitude of the oscillatory motion of the control shaft can consist of an articulated adjustment quadrilateral having one arm of adjustable eccentricity, interposed between said control shaft and a shaft parallel to the former and carrying said toothed sector.

Figure 1:
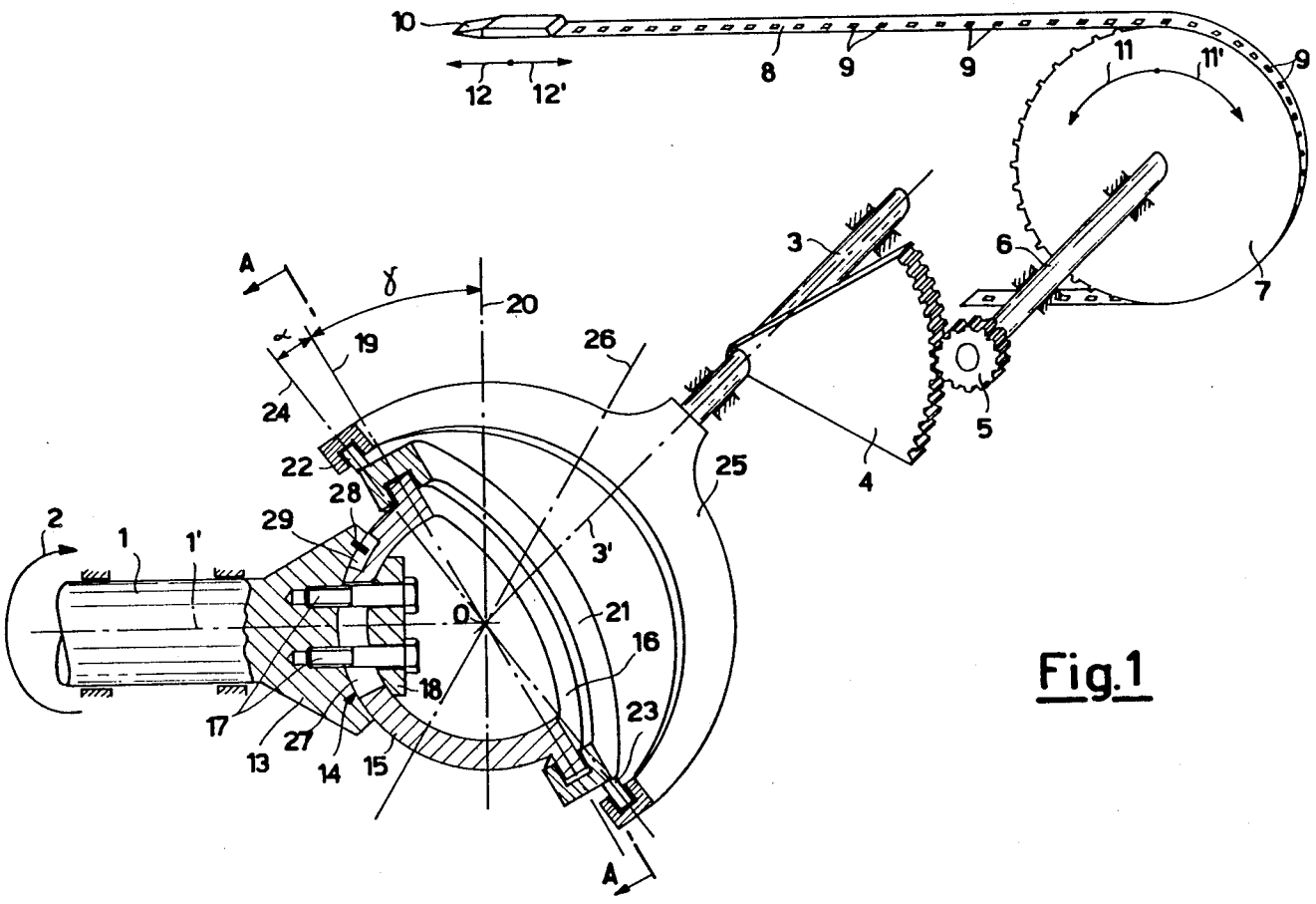
FIG. 1 is a diagrammatic axonometric view showing the conversion of the continuous rotary motion of the main shaft into oscillatory motion of the control shaft in a loom by means of a device according to the invention.
Figure 2:
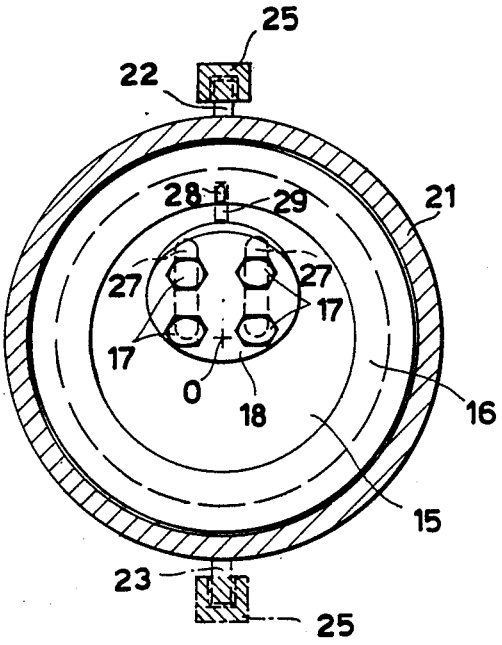
FIG. 2 is a section on the line AA of FIG. 1.

In the figures, the reference numeral 1 indicates the main shaft of a textile loom rotating at uniform angular speed in the direction of the arrow 2, and 3 indicates a control shaft the axis 3' of which is perpendicular to the axis 1' of the main shaft 1, the two axes meeting at a point 0. On said shaft 3 there is fixed the toothed sector 4 of a motion step-up gear which also comprises a pinion 5 engaging said toothed sector 4 and rigid with a shaft 6 disposed parallel to said control shaft 3 and rigid with the sprocket 7 driving the flexible tape 8 which is provided with perforations 9 along its length and carries the gripper 10 at one end.

Said control shaft 3 and consequently the sprocket 7 must be driven by the main shaft 1 with oscillatory motion in the directions of the arrows 11 and 11' so that the gripper 10 is subjected to reciprocating rectilinear motion in the direction of the arrows 12 and 12'.

For this purpose at one end of the main shaft 1 there is provided an enlargement 13 containing a hemispherical cavity 14 with its centre at the point 0, and in which there engages a hemispherical joint 15 also with its centre at 0 and forming an integral part of a circular disc 16 which is fixed in a coaxial position on the main shaft 1 by the through screws 17 and the hemispherical pressure cap 18 so that its centre of symmetry coincides with the point 0 and its plane of symmetry indicated by the line 19 is not perpendicular to the axis 1' of the main shaft 1 but is inclined by a certain angle $\gamma$ to the plane 20 orthogonal to said axis 1'. The outer circular edge of the rotary circular disc 16 engages in the inner U-shaped circumferential groove of a circular collar 21 to form a rotational coupling with biaxial and radial restraints for the circular disc 16, and said circular collar 21 is provided on its outer surface with two 180°-apart opposing pins, 22 and 23 respectively, disposed on the common axis 24 passing through the point 0 and forming a certain angle $\alpha$ with said plane of symmetry 19 of the disc. Finally, said pins 22 and 23 cooperate with the ends of a fork 25 rigid with one end of said control shaft 3. In such a device the continuous rotation of the main shaft 1 causes the hemispherical joint 15 rigid with said shaft to rotate and move the circular disc 16 in continuous succession from the plane 19 to a plane symmetrical with the plane 20, ie the plane 26, with to-and-fro oscillatory motion of amplitude $2\gamma$. Correspondingly the circular collar 21, which cannot rotate with the shaft 1 because it is rigid with the fork 25 disposed orthogonally to the axis 1' of the main shaft 1, undergoes oscillatory motion of amplitude $2\gamma$ which is converted into a corresponding reciprocating rotation of the control shaft 3. From the aforegoing it can be seen that the gripper stroke depends on the angle $\gamma$ at which the disc 16 is fixed so that to vary said gripper stroke it is necessary only to correspondingly vary the angle of inclination of the circular disc 16, ie the angle $\gamma$. For this purpose the hemispherical joint 15 is locked within the cavity 14 by said threaded screws 17 which pass through elongated adjustment slots 27 positioned parallel to each other in said hemispherical joint 15. The hemispherical joint 15 is guided in its movement into the desired angular position by a pin 28 projecting from said hemispherical cavity 14 and penetrating into a guide groove 29 provided in the outer surface of the hemispherical joint 15. To obtain said adjustment, said guide groove 29 and said parallel slots 27 must be disposed in planes substantially parallel to the plane defined by the axis 1' of the main shaft 1 and the perpendicular to the circular disc 16.

We claim:

1. A gripper tape drive device for a shuttleless loom for converting the uniform rotary motion of the main loom shaft into oscillatory motion of a control shaft which is disposed orthogonal to said main shaft and operates the drive sprocket of a longitudinally-perforated gripper-carrying flexible tape by way of a step-up gear consisting of a toothed sector fixed onto said control shaft and engaging a pinion rigid with said sprocket, characterised by comprising a circular disc mounted coaxially at one end of said main loom shaft in a manner not perpendicular to the axis of said main shaft, the outer circular edge of said disc engaging rotatably and with biaxial and radial restraints in a circular collar provided externally with two opposing pins spaced 180° apart and cooperating with the ends of a fork rigid with one end of said control shaft, the axis of which passes through the centre of symmetry of said circular disc, adjustment means being provided for varying the amplitude of the oscillatory motion of said control shaft.

2. A gripper tape drive device as claimed in claim 1, characterised in that said adjustment means for varying the amplitude of the control shaft oscillatory motion consist substantially of a hemispherical joint integral with the circular disc and having its centre at said centre of symmetry of the disc, and engaging in a corresponding hemispherical cavity provided in said end of the main shaft, in which it is locked in the desired angular position by screws passing through elongated adjustment slots provided parallel to each other in said joint, which in its outer surface comprises a guide groove for a pin projecting from said cavity, said groove and said slots being disposed in planes parallel to the plane defined by the axis of the main shaft and the perpendicular to the circular disc.

3. A gripper tape drive device as claimed in claim 1, characterised in that said two 180°-apart opposing pins of said circular collar are disposed on a common axis which passes through said centre of symmetry of the circular disc and forms a certain angle with the plane of the disc passing through said centre of symmetry.

* * * * *

UNITED STATES PATENT AND TRADEMARK OFFICE

CERTIFICATE OF CORRECTION

PATENT NO. : 4,844,132

DATED : July 4, 1989

INVENTOR(S) : Luciano Cinel, et al.

It is certified that error appears in the above-identified patent and that said Letters Patent is hereby corrected as shown below:

Title page:

In the section designated Assignees reading

[73] Assignees: Enricherche, S.p.A., Milan; Enichem Augusta, S.p.A., Palermo, both of Italy Should read

[73] Assignees: Nuovopignone-Industrie Meccaniche E. Fonderia, S.p.A. , Florence, Italy

Signed and Sealed this

Twenty-sixth Day of June, 1990

*Attest:*

HARRY F. MANBECK, JR.

*Attesting Officer*

*Commissioner of Patents and Trademarks*